US010186349B2

(12) United States Patent
Iwasaki et al.

(10) Patent No.: US 10,186,349 B2
(45) Date of Patent: Jan. 22, 2019

(54) NON-HALOGEN FLAME-RETARDANT INSULATED ELECTRIC WIRE AND NON-HALOGEN FLAME-RETARDANT CABLE

(71) Applicant: Hitachi Metals, Ltd., Tokyo (JP)

(72) Inventors: Makoto Iwasaki, Hitachi (JP); Ryutaro Kikuchi, Mito (JP); Mitsuru Hashimoto, Hitachi (JP); Takuya Oriuchi, Takahagi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/170,727

(22) Filed: Jun. 1, 2016

(65) Prior Publication Data

US 2016/0365172 A1 Dec. 15, 2016

(30) Foreign Application Priority Data

Jun. 11, 2015 (JP) ..... 2015-118481

(51) Int. Cl.
*H01B 7/295* (2006.01)
*H01B 3/10* (2006.01)
(Continued)

(52) U.S. Cl.
CPC ..... *H01B 7/295* (2013.01); *H01B 3/10* (2013.01); *H01B 3/441* (2013.01); *H01B 7/0216* (2013.01); *H01B 7/0225* (2013.01)

(58) Field of Classification Search
CPC ..... H01B 7/0208; H01B 7/295
(Continued)

(56) References Cited

U.S. PATENT DOCUMENTS 5,470,657 A * 11/1995 Hayami ..... H01B 3/441 174/110 PM
6,287,692 B1 * 9/2001 Luo ..... C08L 23/06 174/110 PM
(Continued)

FOREIGN PATENT DOCUMENTS

CN 104240808 A 12/2014
JP 2006-008873 A 1/2006
WO WO 01/51554 * 7/2001

OTHER PUBLICATIONS

Chinese Office Action dated Sep. 21, 2018, in counterpart Chinese Patent Application No. 201610208321.X, with an English translation thereof.

*Primary Examiner* — Chau N Nguyen
(74) *Attorney, Agent, or Firm* — McGinn I. P. Law Group, PLLC

(57) ABSTRACT

A non-halogen flame-retardant insulated electric wire and a non-halogen flame-retardant cable that have excellent abrasion resistance, terminal processability, and handling ease in a high-temperature environment are provided. A non-halogen flame-retardant insulated electric wire includes a conductor and a crosslinked single-layer or multilayer insulating layer on an outer periphery of the conductor. The insulating layer has a tensile elastic modulus of 500 MPa or more and an elongation at break of 120% or less in a tensile test performed at a displacement rate of 200 mm/min, and has a storage elastic modulus at 125° C. of $3\times10^6$ Pa or more in a dynamic viscoelasticity test.

4 Claims, 2 Drawing Sheets

(51) Int. Cl.
*H01B 3/44* (2006.01)
*H01B 7/02* (2006.01)

(58) Field of Classification Search
USPC ..... 174/110 R, 120 R, 121 A
See application file for complete search history.

(56) References Cited

U.S. PATENT DOCUMENTS

| | | | | |
|---|---|---|---|---|
| 7,244,892 | B2 * | 7/2007 | Toshimitsu | C08K 3/22<br>174/110 R |
| 2007/0155883 | A1 * | 7/2007 | Sato | H01B 3/448<br>524/420 |
| 2009/0114417 | A1 * | 5/2009 | Nakayama | H01B 7/295<br>174/110 SR |
| 2009/0301756 | A1 * | 12/2009 | Hase | H01B 3/30<br>174/120 SR |
| 2010/0069545 | A1 * | 3/2010 | Gau | H01B 3/025<br>524/261 |
| 2010/0101822 | A1 * | 4/2010 | Bunker | C08F 255/02<br>174/110 SR |
| 2012/0292078 | A1 * | 11/2012 | Kibe | C08K 3/22<br>174/110 SR |
| 2014/0141241 | A1 * | 5/2014 | Nishi | H01B 3/441<br>428/379 |
| 2014/0370286 | A1 | 12/2014 | Iwasaki et al. | |

* cited by examiner

NON-HALOGEN FLAME-RETARDANT INSULATED ELECTRIC WIRE AND NON-HALOGEN FLAME-RETARDANT CABLE

The present application is based on Japanese patent application No.2015-118481 filed on Jun. 11, 2015, the entire contents of which are incorporated herein by reference.

BACKGROUND OF THE INVENTION

1. Field of the Invention

The present invention relates to a non-halogen flame-retardant insulated electric wire and a non-halogen flame-retardant cable.

2. Description of the Related Art

Electric wires and cables used in rolling stock, automobiles, devices, etc., desirably have high abrasion resistance, flame retardancy, good low-temperature characteristics, and other properties as occasion demands.

Polyvinyl chloride (PVC), which is inexpensive and highly flame retardant, has been widely used as the electric wire coating material. However, PVC contains halogen and releases halogen gas when burned, raising environmental issues. Thus, non-halogen electric wire coating materials have been sought after.

One approach to obtaining a non-halogen flame retardant electric wire known in the art is to load the coating material with a metal hydroxide, such as magnesium hydroxide or aluminum hydroxide, that acts as a flame retardant. In order to load the coating material with such a flame retardant, a soft polyolefin, such as an ethylene-vinyl acetate copolymer (EVA) or an ethylene-acrylic acid ester copolymer, is used as a base polymer of a coating material (refer to Japanese Unexamined Patent Application Publication No. 2006-8873).

However, soft polyolefins such as EVA have low strength, deform easily, are susceptible to abrasion, and are easily damaged.

Moreover, in stripping an electric wire terminal by using a wire stripper or the like, the coating material may become stretched and a clean cut may not be obtained, thereby leaving some part of the coating material on a conductor in some instances. When this happens, sparks occur during resistance welding and render the process difficult to perform.

Moreover, electric wires may fuse to each other or deform in a high-temperature environment involving a temperature higher than the melting point of the coating material. This makes inspection of wiring and replacement operation difficult.

SUMMARY OF THE INVENTION

In view of the foregoing and other exemplary problems, drawbacks, and disadvantages of the conventional methods and structures, an exemplary feature of the present invention is to provide non-halogen flame-retardant insulated electric wire and non-halogen flame-retardant cable.

It is desirable to provide a non-halogen flame-retardant insulated electric wire and a non-halogen flame-retardant cable that have excellent abrasion resistance, terminal processability, and high handling ease in a high-temperature environment.

The present invention provides the following non-halogen flame-retardant insulated electric wire and non-halogen flame-retardant cable.

[1] A non-halogen flame-retardant insulated electric wire comprising a conductor and a crosslinked single-layer or multilayer insulating layer on an outer periphery of the conductor, in which the insulating layer has a tensile elastic modulus of 500 MPa or more and an elongation at break of 120% or less in a tensile test performed at a displacement rate of 200 mm/min, and has a storage elastic modulus at 125° C. of $3\times10^6$ Pa or more in a dynamic viscoelasticity test.

[2] The non-halogen flame-retardant insulated electric wire described in [1], in which the insulating layer has an outermost layer formed of a coating material that contains magnesium hydroxide and/or aluminum hydroxide and has a specific gravity of 1.4 or more.

[3] The non-halogen flame-retardant insulated electric wire described in [1] or [2], in which the insulating layer has an outermost layer formed of a coating material that includes a melting point peak of 120° C. or higher in differential scanning calorimetry.

[4] The non-halogen flame-retardant insulated electric wire described in [2] or [3], in which the coating material contains, as a base polymer, a polyolefin having a melting point of 120° C. or higher.

[5] The non-halogen flame-retardant insulated electric wire described in [4], in which the coating material also contains, as the base polymer, a polyolefin having a melting point lower than 120° C.

[6] A non-halogen flame-retardant cable comprising a crosslinked sheath in an outermost layer, the crosslinked sheath having a tensile elastic modulus of 500 MPa or more and an elongation at break of 120% or less in a tensile test performed at a displacement rate of 200 mm/min, and having a storage elastic modulus at 125° C. of $3\times10^6$ Pa or more in a dynamic viscoelasticity test.

[7] The non-halogen flame-retardant cable described in [6], in which the sheath is formed of a coating material that contains magnesium hydroxide and/or aluminum hydroxide and has a specific gravity of 1.4 or more.

[8] The non-halogen flame-retardant cable described in [6] or [7], in which the sheath is formed of a coating material that includes a melting point peak of 120° C. or higher in differential scanning calorimetry.

The present invention thus provides a non-halogen flame-retardant insulated electric wire and a non-halogen flame-retardant cable that have excellent abrasion resistance, terminal processability, and high handling ease in a high-temperature environment.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE PREFERRED EMBODIMENTS

Figure 1:
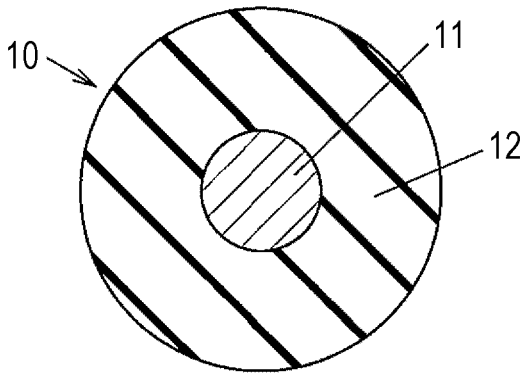
FIG. 1 is a cross-sectional view of an embodiment (single-layer insulating layer) of an insulated electric wire according to the present invention.
Figure 2:
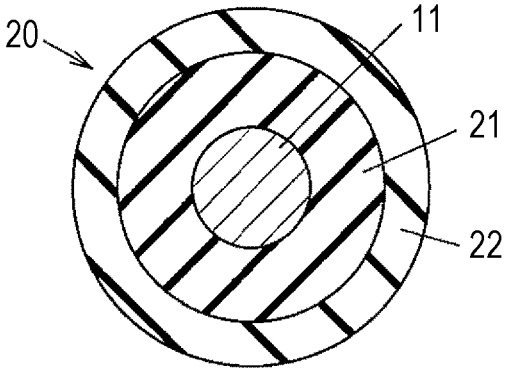
FIG. 2 is a cross-sectional view of an embodiment (double-layer insulating layer) of an insulated electric wire according to the present invention.
Figure 3:
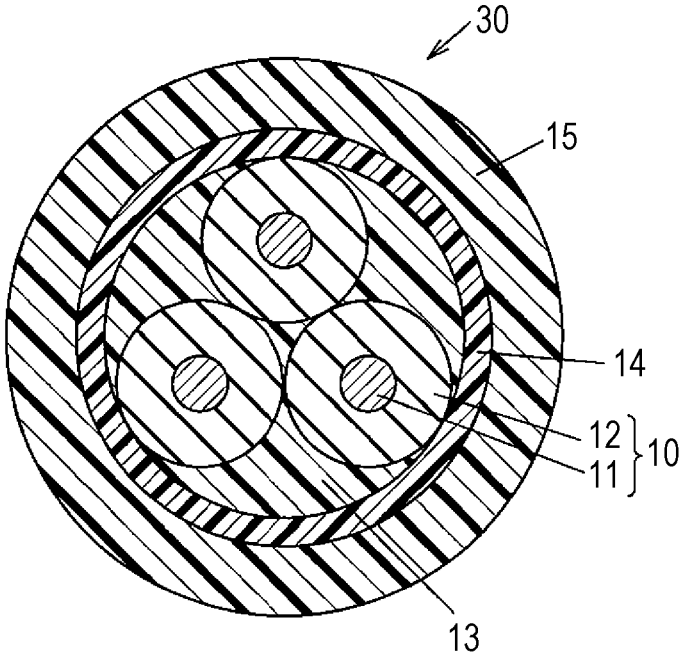
FIG. 3 is a cross-sectional view of an embodiment of a cable according to the present invention.

Referring now to the drawings, and more particularly to FIGS. 1-3, there are shown exemplary embodiments of the structures according to the present invention.

Non-halogen flame-retardant insulated electric wire

A non-halogen flame-retardant insulated electric wire according to one embodiment of the present invention includes a crosslinked single-layer or multilayer insulating layer on the outer periphery of a conductor. The insulating layer has a tensile elastic modulus of 500 MPa or more and an elongation at break of 120% or less in a tensile test performed at a displacement rate of 200 mm/min, and has a storage elastic modulus at 125° C. of $3\times10^6$ Pa or more in a dynamic viscoelasticity test.

FIGS. 1 and 2 are cross-sectional views showing embodiments of the insulated electric wire according to the present invention. FIG. 1 shows an embodiment in which the insulating layer is a single layer. FIG. 2 shows an embodiment in which the insulating layer is constituted by two layers. Embodiments of the present invention will now be described with reference to the drawings.

According to embodiments of the present invention, the insulating layer may be constituted by one layer as shown in FIG. 1 or may have a multilayer structure constituted by two or more layers (in FIG. 2, an example of a double-layer insulating layer is shown).

An insulated electric wire 10 of an embodiment shown in FIG. 1 includes a conductor 11 and an insulating layer 12 directly covering the conductor 11. The insulating layer 12 can be formed by extrusion molding.

An insulated electric wire 20 according to an embodiment shown in FIG. 2 includes a conductor 11, an inner insulating layer 21 directly covering the conductor 11, and an outer insulating layer 22 covering the inner insulating layer 21. The insulating layers 21 and 22 can be formed simultaneously by co-extrusion.

Conductor

The conductor 11 may be a conductor obtained by stranding tin-coated annealed copper wires, but is not particularly limited. The conductor outer diameter may be any and may be, for example, about 0.15 to 7 mm. The number of conductors that serve as the conductor 11 may be 1 as illustrated in FIG. 1, or more than 1.

Insulating layer

The single-layer insulating layer 12 illustrated in FIG. 1 has a tensile elastic modulus of 500 MPa or more and an elongation at break of 120% or less in a tensile test performed at a displacement rate of 200 mm/min, and a storage elastic modulus at 125° C. of $3\times10^6$ Pa or more in a dynamic viscoelasticity test.

If the tensile elastic modulus is less than 500 MPa, abrasion resistance is not obtained. The tensile elastic modulus is preferably 600 MPa or more. A tensile elastic modulus of 700 MPa or more is more preferable, since fracture does not easily occur even when the insulating layer is pressed against a sharp edge or the like.

If the elongation at break is higher than 120%, the coating material deforms during electric wire terminal stripping and is likely to remain on the conductor, resulting in insufficient terminal processability. The elongation at break may be any value equal to or less than 120%, but is preferably 110% or less and more preferably 100% or less.

When the storage elastic modulus at 125° C. is $3\times10^6$ Pa or more, fusion and deformation of the electric wires can be reduced in the 125° C. environment. The storage elastic modulus at 125° C. is preferably $3.5\times10^6$ Pa or more and more preferably $4\times10^6$ Pa or more.

For a multilayer insulating layer, the above-described properties are to be satisfied by the multilayer insulating layer as a whole. For example, in the case of two layers illustrated in FIG. 2, the inner insulating layer 21 and the outer insulating layer 22 as a whole are to satisfy the properties. An insulating layer that has the above-described properties as a whole is formed as an outermost layer of an insulated electric wire.

The outermost layer (the insulating layer 12 in FIG. 1 and the outer insulating layer 22 in FIG. 2) of the insulating layer is preferably formed of a coating material having a specific gravity of 1.4 or more in order to enhance flame retardancy.

The outermost layer of the insulating layer is preferably formed of a coating material that contains a melting point peak of 120° C. or higher in a differential scanning calorimetry (DSC). This is because the above-described properties are easily obtained.

The coating material constituting the outermost layer of the insulating layer contains any non-halogen polyolefin as a base polymer without limitation. However, a polyolefin having a melting point of 120° C. or higher is preferably contained since excellent terminal processability is easily obtained, for example. Examples of the polyolefin having a melting point of 120° C. or higher include straight-chain low-density polyethylene, high-density polyethylene, and polypropylene. These can be used alone or in combination.

In 100 parts by mass of the base polymer, preferably 25 to 55 parts by mass, more preferably 30 to 50 parts by mass, and yet more preferably 35 to 45 parts by mass of the polyolefin having a melting point of 120° C. or higher is contained.

Engineering plastics such as polybutylene terephthalate are also available as the polymer having a melting point of 120° C. or higher, but are preferably not used since it is difficult to load these plastics with a non-halogen flame retardant.

The coating material preferably contains, as a base polymer, a polyolefin having a melting point lower than 120° C. as well as the polyolefin having a melting point of 120° C. or higher in order to enhance the flame retardant loadability. Examples of the polyolefin having a melting point lower than 120° C. include low-density polyethylene, ultralow-density polyethylene, ethylene-acrylic acid ester copolymers, ethylene-vinyl acetate copolymers, ethylene-propylene copolymers, ethylene-octene copolymers, ethylene-butene copolymers, and butadiene-styrene copolymers. These materials may be modified with an acid such as maleic acid. These materials may be used alone or in combination. One of the above-described materials modified with an acid such as maleic acid may be used in combination with one of the above-described materials unmodified.

In 100 parts by mass of the base polymer, preferably 45 to 75 parts by mass, more preferably 50 to 70 parts by mass, and yet more preferably 55 to 65 parts by mass of the polyolefin having a melting point lower than 120° C. is contained.

The flame retardant used in the coating material constituting the outermost layer of the insulating layer may be any non-halogen flame retardant. Magnesium hydroxide and aluminum hydroxide, which are metal hydroxides, are particularly preferable. These may be used alone or in combination. Magnesium hydroxide is more preferable since the main dehydration reaction is at 350° C., which is high, and exhibits excellent flame retardancy. Phosphorus flame retardants such as red phosphor and triazine flame retardants such melamine cyanurate are also available as the non-halogen flame retardants. However, they release phosphine gas and cyan gas harmful to human body and thus are not preferable.

Other specific examples of the non-halogen flame retardants that can be used include clay, silica, zinc stannate, zinc borate, calcium borate, dolomite hydroxide, and silicone.

In view of dispersibility, the flame retardant may be surface-treated with a silane coupling agent, a titanate coupling agent, or a fatty acid such as stearic acid.

The amount of the flame retardant added is not particularly limited but when the polyolefin is highly loaded with magnesium hydroxide or aluminum hydroxide and the specific gravity of the coating material is adjusted to 1.4 or more, high flame retardancy can be obtained. For example, 110 to 190 parts by mass of magnesium hydroxide or aluminum hydroxide is added to 100 parts by mass of the base polymer.

To the coating material (resin composition) constituting the outermost layer of the insulating layer, various additives can be added as needed. Examples of the additives include a crosslinking agent, a crosslinking aid, a flame retardant, a flame retarding aid, an ultraviolet absorber, a photostabilizer, a softener, a lubricant, a coloring agent, a reinforcing agent, a surfactant, an inorganic filler, an antioxidant, a plasticizer, a metal chelating agent, a blower, a compatibilizer, a processing aid, and a stabilizer.

A layer other than the outermost layer of the insulating layer (such a layer is absent in FIG. 1 and is the inner insulating layer 21 in FIG. 2) may be formed of any material as long as the above-described properties are exhibited as the whole insulating layer. For example, any non-halogen resin composition may be used. The base polymer may be any. Examples of the base polymer include polyolefins such as high-density polyethylene, medium-density polyethylene, low-density polyethylene, ultralow-density polyethylene, and ethylene-acrylic acid ester copolymers. These polyolefins may be used alone or as a blend of two or more. If needed, the above-described various additives such as a crosslinking agent may be added to the coating material (resin composition) that constitutes the layer other than the outermost layer of the insulating layer.

The insulating layer 12, the inner insulating layer 21, and the outer insulating layer 22 are each formed by performing crosslinking after molding. Examples of the crosslinking method include chemical crosslinking that uses an organic peroxide, a sulfur compound, silane, or the like, irradiation crosslinking that uses an electron beam, a radiation, or the like, and crosslinking that involves other chemical reactions. Any of these crosslinking methods may be employed.

The insulated electric wires 10 and 20 may each be equipped with a braided line or the like, if needed.

Non-halogen Flame-retardant Cable

A non-halogen flame-retardant cable according to an embodiment of the present invention includes a crosslinked sheath that constitutes an outermost layer, the crosslinked sheath having a tensile elastic modulus of 500 MPa or more and an elongation at break of 120% or less in a tensile test performed at a displacement rate of 200 mm/min, and a storage elastic modulus at 125° C. of $3\times10^6$ Pa or more in a dynamic viscoelasticity test.

FIG. 3 is a cross-sectional view of an embodiment of a cable according to the present invention. Embodiments of the present invention are described below with reference to the drawings.

A cable 30 according to this embodiment includes a three-core wire prepared by bundling, together with a filler 13 such as paper, three single-layer insulated electric wires 10 of the above-described embodiment each including a conductor 11 and an insulating layer 12 covering the conductor 11, a binding tape 14 wound around the outer periphery of the three-core wire, and a sheath 15 extruded onto the outer periphery of the binding tape 14. The wire is not limited to a three-core wire, and may alternatively be one electric wire (single core) or a multicore wire including 2 or 4 or more cores. The binding tape 14 may be omitted or replaced by a braid.

The sheath 15 having the above-described properties is preferably formed of the coating material (resin composition) that constitutes the insulating layer 12 and the outer insulating layer 22. In this embodiment, the insulating layer 12 also has the above-described properties and is formed of the coating material (resin composition) described above. However, the insulating layer 12 is not limited to this and may be formed of a different resin composition for forming an insulating layer (preferably a non-halogen flame retardant resin composition). The sheath 15 is subjected to a crosslinking process through electron beam irradiation or the like after molding.

In this embodiment, the sheath has a single layer structure as illustrated in FIG. 3. Alternatively, the sheath may have a multilayer structure. In this case, at least the outermost layer is to have the properties described above and be formed of the coating material (resin composition) described above. Although the single-layer insulated electric wire 10 illustrated in FIG. 1 is used, the double-layer insulated electric wire 20 illustrated in FIG. 2 can be used instead in this embodiment.

The cable 30 may be equipped with a braided line or the like, if needed.

EXAMPLES

The present invention will now be described in further detail through Examples. The present invention is in no way limited by the examples described below.

A single-layer insulated electric wire 10 illustrated in FIG. 1 and a double-layer insulated electric wire 20 illustrated in FIG. 2 were fabricated as follows.

(1) A 37 strands/0.18 mm tin-coated conductor was used as the conductor 11.

(2) Components in Tables 1 and 2 were blended and kneaded with a 14-inch open roll to prepare a resin composition. The resin compositions were pelletized with a pelletizer to obtain an outer-layer material and an inner-layer material.

(3) In fabricating a single-layer insulated electric wire 10 illustrated in FIG. 1, the obtained outer-layer material was extruded onto the conductor 11 by using a 40 mm extruder so as to form an insulating layer 12 having a thickness of 0.26 mm on the conductor 11.

(4) In fabricating a double-layer insulated electric wire 20 illustrated in FIG. 2, the obtained outer-layer material and inner-layer material were co-extruded with a 40 mm extruder so that an inner insulating layer 21 having a thickness of 0.1 mm and an outer insulating layer 22 having a thickness of 0.16 mm are formed on the conductor 11.

(5) The obtained insulated electric wire was irradiated with an electron beam to conduct crosslinking (irradiation dose: 15 Mrad in Examples and Comparative Example 1, 10 Mrad in Comparative Example 2, 20 Mrad in Comparative Example 3, and 2 Mrad in Comparative Example 5). No crosslinking was performed in Comparative Example 4.

The specific gravity of the insulating layer 12 of the single-layer insulated electric wire 10 and the outer insulating layer 22 of the double-layer insulated electric wire 20 was measured in accordance with JIS-Z8807. The obtained crosslinked insulated electric wire was subjected to tests described below. The results are shown in Table 1.

(1) Tensile Test

The insulating layer after removal of the conductor 11 was subjected to a tensile test in accordance with JIS C3005 at a tensile rate of 200 mm/min. Samples with a tensile elastic modulus of 500 MPa or more and an elongation at break of 120% or less were rated pass (A).

(2) Dynamic Viscoelasticity Test

The insulating layer after removal of the conductor 11 was subjected to a dynamic viscoelasticity test in accordance with JIS K7244-4 at a frequency of 10 Hz, a strain of 0.08%, and a temperature elevation rate of 10° C/min. Samples having a storage elastic modulus at 125° C. of $3\times10^6$ Pa or more were rated pass (A).

(3) Abrasion Test

The insulated electric wire was evaluated in accordance with EN50305.5.2. Samples withstanding 150 or more abrasion cycles were rated pass (A) and samples withstanding less than 150 cycles were rated fail (F).

(4) Terminal Processability Test

Ten insulated electric wire terminals were each stripped 10 mm with a wire stripper. Samples with which all ten wires could be processed without stretching the insulating layers were rated pass (A) and other samples were rated fail (F).

(5) Fusion Deformation Test (Handling Ease of Electric Wire in High-temperature Environment)

Ten insulated electric wires were bundled and put in a 125° C. constant-temperature oven. Samples in which the number of electric wires that fused to each other or deformed was less than 5 were rated pass (A), and samples in which the number was 5 or more were rated fail (F).

(6) Flame Retardancy Test

An insulated electric wire having a length of 600 mm was kept upright, and flame of a Bunsen burner was applied to the insulated electric wire for 60 seconds. After the flame was removed, the char length was measured. Samples with a char length less than 300 mm were rated excellent (AA), samples with a char length less than 400 mm were rated good (A), samples with a char length less than 450 mm were rated fair (B), and samples with a char length equal to or more than 450 mm were rated poor (F). Samples rated AA to B were pass, and samples rated F were fail.

(7) Comprehensive Evaluation

For comprehensive evaluation, samples rated AA or A in all of the tests (3) to (6) above were rated pass (AA), samples that included the B rating were also rated pass (A), and samples that included the F rating were rated fail (F).

The materials used indicated in Table 1 were as follows:

1) High-density polyethylene (HDPE) (produced by Prime Polymer Co., Ltd., tradename: HI-ZEX 5305E) (melting point: 131° C.)
2) Linear low-density polyethylene (LLDPE) (produced by Japan Polyethylene Corporation, tradename: NOVATEC UF420) (melting point: 123° C.)
3) Low-density polyethylene (LDPE) (produced by Sumitomo Chemical Co., Ltd., tradename: SUMIKATHENE F208-O) (melting point: 112° C.)
4) Ethylene-ethyl acrylate-maleic anhydride ternary copolymer (M-EEA) (produced by Arkema K. K., tradename: BONDINE LX4110) (melting point: 107° C.)
5) Ethylene-vinyl acetate copolymer (EVA) (produced by Du Pont-Mitsui Polychemicals Co., Ltd., tradename: Evaflex EV170) (melting point: 62° C.)
6) Ethylene-ethyl acrylate copolymer (EEA) (produced by Japan Polyethylene Corporation, tradename: REXPEARL A1150) (melting point: 100° C.)
7) Magnesium hydroxide (produced by Kyowa Chemical Industry Co., Ltd., tradename: KISUMA 5L)
8) Aluminum hydroxide (produced by Nippon Light Metal Co., Ltd., tradename: BF013STV)

TABLE 1

| | | Example | | | | | | | | | |
|---|---|---|---|---|---|---|---|---|---|---|---|
| | | Examples | | | | | Comparative Examples | | | | |
| | Items | 1 | 2 | 3 | 4 | 5 | 1 | 2 | 3 | 4 | 5 |
| Outer layer* | HDPE[1)] | 40 | — | — | 40 | — | — | — | — | — | — |
| | LLDPE[2)] | — | 40 | 40 | — | 40 | — | — | — | — | 40 |
| | LDPE[3)] | — | — | — | — | — | 40 | — | — | — | — |
| | M-EEA[4)] | 30 | 30 | 30 | 30 | 30 | 30 | — | — | — | 30 |
| | EVA[5)] | 30 | — | — | — | — | — | 100 | 100 | 100 | — |
| | EEA[6)] | — | 30 | 30 | 30 | 30 | 30 | — | — | — | 30 |
| | Magnesium hydroxide[7)] | 150 | 150 | 180 | 120 | — | 100 | 200 | 200 | 200 | 150 |
| | Aluminum hydroxide[8)] | — | — | — | — | 150 | — | — | — | — | — |
| | Other 1 (Table 2) | 7 | 7 | 7 | 7 | 7 | 7 | 7 | 7 | 7 | 7 |
| Inner layer* | LLDPE[2)] | — | 100 | 100 | — | 100 | 100 | 100 | 100 | 100 | 100 |
| | Other 2 (Table 2) | — | 12 | 12 | — | 12 | 12 | 12 | 12 | 12 | 12 |
| Outer layer specific gravity | | 1.44 | 1.44 | 1.48 | 1.41 | 1.44 | 1.39 | 1.50 | 1.50 | 1.50 | 1.44 |
| Irradiation dose (Mrad) | | 15 | 15 | 15 | 15 | 15 | 15 | 10 | 20 | 0 | 2 |
| Evaluation | Tensile elastic modulus (MPa), 500 MPa or more | 710 A | 530 A | 600 A | 750 A | 510 A | 500 A | 150 F | 170 F | 95 F | 250 F |
| | Elongation at break (%), 120% or less | 110 A | 120 A | 90 A | 100 A | 105 A | 130 F | 200 F | 100 A | 400 F | 170 F |
| | Storage elastic modulus (Pa), $3\times10^6$ Pa or more | $4\times10^6$ A | $3.3\times10^6$ A | $3.7\times10^6$ A | $4\times10^6$ A | $3.2\times10^6$ A | $3.2\times10^6$ A | $2.8\times10^6$ F | $3.0\times10^6$ A | 0 F | $2.0\times10^5$ F |

TABLE 1-continued

| Items | Example | | | | | | | | | |
|---|---|---|---|---|---|---|---|---|---|---|
| | Examples | | | | | Comparative Examples | | | | |
| | 1 | 2 | 3 | 4 | 5 | 1 | 2 | 3 | 4 | 5 |
| Abrasion cycle | 400 | 180 | 410 | 320 | 165 | 160 | 10 | 11 | 2 | 3 |
| rating | A | A | A | A | A | A | F | F | F | F |
| Terminal processability | A | A | A | A | A | F | F | A | F | F |
| Fusion deformation evaluation | A | A | A | A | A | A | F | A | F | F |
| Flame retardancy test, char length (mm) | 100 | 200 | 150 | 250 | 400 | 300 | 80 | 80 | 110 | 250 |
| rating | AA | AA | AA | AA | B | A | AA | AA | AA | AA |
| Comprehensive evaluation | AA | AA | AA | AA | A | F | F | F | F | F |

The unit of the contents of the components is parts by mass.

TABLE 2

| | Other additives | Manufacturer | Amount added (parts by mass) |
|---|---|---|---|
| Other 1 | IRGANOX 1010 (pentaerythritol tetrakis[3-(3,5-di-tert-butyl-4-hydroxyphenyl)propionate]) | BASF | 2 |
| | TMPT (trimethylol propane trimethacrylate) | Shin Nakamura Chemical | 4 |
| | SZ-P (zinc stearate) | Sakai Chemical | 1 |
| | Total | | 7 |
| Other 2 | IRGANOX 1010 (pentaerythritol tetrakis[3-(3,5-di-tert-butyl-4-hydroxyphenyl)propionate]) | BASF | 2 |
| | AO-412S (2,2-bis[[3-(dodecylthio)-1-oxopropyloxy]methyl]-1,3-propanediyl bis[3-(dodecylthio)propionate] | ADEKA | 1 |
| | CDA-6 (decamethylenedicarboxylic acid disalicyloylhydrazide) | ADEKA | 4 |
| | TMPT (trimethylol propane trimethacrylate) | Shin Nakamura Chemical | 4 |
| | SZ-P (zinc stearate) | Sakai Chemical | 1 |
| | Total | | 12 |

Table 1 shows that samples of Example 1 to 4 were rated AA or A in all tests and thus were rated pass (AA) in the comprehensive evaluation. Samples of Example 5 were rated B in flame retardancy test and A in all other tests, and thus were rated pass (A) in the comprehensive evaluation.

The results of Comparative Examples 1 to 5 described in Table 1 were as follows.

In Comparative Example 1, the elongation at break exceeded 120%, and thus the terminal processability was rated fail (F). Thus, the comprehensive evaluation was fail (F).

In Comparative Example 2, the tensile elastic modulus was less than 500 MPa, the elongation at break exceeded 120%, and the storage elastic modulus at 125° C. was less than $3\times10^6$ Pa. Thus, all the ratings except for the rating in the flame retardancy test were fail (F). Thus, the comprehensive evaluation was fail (F).

In Comparative Example 3, the tensile elastic modulus was less than 500 MPa and thus the abrasion cycle was rated fail (F). Thus, the comprehensive evaluation was fail (F).

In Comparative Example 4, the insulating layer was not crosslinked, the tensile elastic modulus was less than 500 MPa, the elongation at break exceeded 120%, and the storage elastic modulus at 125° C. was less than $3\times10^6$ Pa. Thus, the ratings were all fail except for the flame retardancy test.

The comprehensive evaluation was fail (F).

In Comparative Example 5, the tensile elastic modulus was less than 500 MPa, the elongation at break exceeded 120%, and the storage elastic modulus at 125° C. was less than $3\times10^6$ Pa. Thus, the ratings were all fail (F) except for the flame retardancy test. The comprehensive evaluation was fail (F).

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted than Applicant's intent is to encompass equivalents of all claim elements, even if amended later during prosecution.

What is claimed is:

1. A non-halogen flame-retardant cable, comprising;

two or more core wires each including:

a conductor;

a crosslinked multilayer insulating sheath covering the conductor, wherein the crosslinked multilayer insulating sheath comprises an inner insulating layer and an outer insulating layer covering the inner insulating layer, wherein the outer insulating layer comprises a coating material that consists of 35 parts by mass to 45 parts by mass of a polyolefin having a melting point of 120° C. or higher and 55 parts by mass to 65 parts by mass of a polyolefin having a melting point lower than 120° C. as a base polymer, wherein the inner insulating layer comprises a coating material that consists of linear low-density polyethylene as a base polymer, wherein the polyolefin having the melting point lower than 120° C. consists of high-density polyethylene or linear low-density polyethylene, wherein the polyolefin having the melting point of 120° C. or higher consists of a group of an ethylene-ethyl acrylate-maleic anhydride ternary copolymer and an ethylene-vinyl acetate copolymer or a group of an ethylene-ethyl acrylate-maleic anhydride ternary copolymer and an ethylene-ethyl acrylate copolymer, wherein the coating material of the outer insulating layer contains at least one of magnesium hydroxide and aluminum hydroxide, and has a specific gravity of 1.4 or more, wherein the outer insulating layer comprises a non-halogen flame-retardant material, and wherein the outer insulating layer and the inner insulating layer as a whole has a tensile elastic modulus of 500 MPa or more and au elongation at break of 120% or less in a tensile test performed at a displacement rate of 200 mm/min, and has a storage elastic modulus at 125° C. of $3\times10^6$ Pa or more in a dynamic viscoelasticity test.

2. The non-halogen flame-retardant cable according to claim 1, wherein the coating material of the outer insulating layer has the melting point peak of 120° C. or higher in a differential scanning calorimetry.

3. The non-halogen flame-retardant cable according to claim 1, wherein the non-halogen flame retardant material is surface-treated with one of a silane coupling agent, a titanate coupling agent, and a fatty acid.

4. A non-halogen flame-retardant electric wire, comprising:

a conductor; and a crosslinked multilayer insulating layer on an outer periphery of the conductor, wherein the crosslinked multilayer insulating layer comprises an inner insulating layer and an outer insulating layer covering the inner insulating layer, wherein the outer insulating layer includes a coating material that consists as a base polymer of 35 parts by mass to 45 parts by mass of a polyolefin having a melting point of 120° C. or higher and 55 to 65 parts by mass of a polyolefin having a melting point lower than 120° C., wherein the inner insulating layer includes a coating material that consists as a base polymer of linear low-density polyethylene, wherein the polyolefin having the melting point lower than 120° C. consists of high-density polyethylene or linear low-density polyethylene, wherein the polyolefin having the melting point of 120° C. or higher consists of a group of an ethylene-ethyl acrylate-maleic anhydride ternary copolymer and an ethylene-vinyl acetate copolymer or a group of an ethylene-ethyl acrylate-maleic anhydride ternary copolymer and an ethylene-ethyl acrylate copolymer, and wherein the outer insulating layer and the inner insulating layer as a whole has a tensile elastic modulus of 500 MPa or more and an elongation at break of 120% or less in a tensile test performed at a displacement rate of 200 mm/min, and has a storage elastic modulus at 125° C. of $3\times10^6$ Pa or more in a dynamic viscoelasticity test.

* * * * *